US011506377B1

(12) United States Patent
Wang

(10) Patent No.: US 11,506,377 B1
(45) Date of Patent: Nov. 22, 2022

(54) LAMP INSTALLATION STRUCTURE OF CEILING FAN

(71) Applicant: AIR COOL INDUSTRIAL CO., LTD., Taichung (TW)

(72) Inventor: Cliff Wang, Taichung (TW)

(73) Assignee: AIR COOL INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 17/491,194

(22) Filed: Sep. 30, 2021

(51) Int. Cl.

| | |
|---|---|
| ***F21V 21/03*** | (2006.01) |
| ***F21V 33/00*** | (2006.01) |
| ***F21V 21/04*** | (2006.01) |
| ***F21V 29/74*** | (2015.01) |
| *F21W 131/30* | (2006.01) |

(52) U.S. Cl.
CPC ..... *F21V 33/0096* (2013.01); *F21V 21/03* (2013.01); *F21V 21/044* (2013.01); *F21V 21/047* (2013.01); *F21V 29/74* (2015.01); *F21W 2131/30* (2013.01)

(58) Field of Classification Search
CPC ..... F21V 33/0096; F21V 21/03; F21V 17/14; F21V 17/18
See application file for complete search history.

(56) References Cited

U.S. PATENT DOCUMENTS

| | | | | |
|---|---|---|---|---|
| 6,350,045 | B1 * | 2/2002 | Pearce | F21V 17/164 362/438 |
| 2012/0106177 | A1 * | 5/2012 | Blankestijn | F21V 19/04 362/382 |
| 2018/0058476 | A1 * | 3/2018 | Jones | H01R 13/6278 |
| 2020/0208809 | A1 * | 7/2020 | Zhang | F21S 8/063 |

* cited by examiner

*Primary Examiner* — Julie A Bannan
(74) *Attorney, Agent, or Firm* — Pai Patent & Trademark Law Firm; Chao-Chang David Pai

(57) ABSTRACT

A lamp installation structure of a ceiling fan has a first base connected to a fixing seat of the ceiling fan and a second base connected to a lamp. The first base is provided with a plurality of positioning members. The second base has grooves and guide rails corresponding to the positioning members for insertion of the positioning members. The guide rails are provided with a plurality of elastic members to elastically press against the positioning members. Thereby, through the positioning members being retained to the guide rails, the lamp installation structure of the ceiling fan has the advantages of quick installation and increased stability of the ceiling fan.

7 Claims, 9 Drawing Sheets

LAMP INSTALLATION STRUCTURE OF CEILING FAN

FIELD OF THE INVENTION

The present invention relates to a lamp of a ceiling fan, and more particularly to a lamp installation structure of a ceiling fan.

BACKGROUND OF THE INVENTION

Ceiling fans are fixed to the ceiling. In order to save the installation space, a lamp is provided and coupled under the ceiling fan. With the lamp, the ceiling fan also provides a lighting effect. However, because the lamp is integrated with and fixed to the ceiling fan, the user cannot replace a desired lamp. It is also impossible to change the lighting brightness of the lamp according to different demands. This causes great inconvenience in use.

Therefore, an improved lamp structure of a ceiling fan is developed on the market. As shown in FIG. 1, a connecting cap body 3 is connected between a fixing member 1 and a lamp 2 of the ceiling fan. The connecting cap body 3 is provided with an inner groove seat portion 4. The edge of the inner groove seat portion 4 is provided with a bottom plate 5 extending outwardly. The bottom plate 5 is formed with a plurality of engaging grooves 6. One end of each engaging groove 6 is formed with a positioning hole 7. The screws 8 of the lamp 2 pass through the corresponding positioning holes 7 of the connecting cap body 3, and the screws 8 are moved to the corresponding engaging grooves 6, respectively. The screws 8 of the lamp 2 are positioned in the respective engaging grooves 6, so that the fixing member 1 of the ceiling fan and the lamp 2 are combined and secured. However, if the ceiling fan runs and vibrates for a long time, the screws 8 may be loose or displaced, that is, the screws 8 may move from the engaging grooves 6 to the positioning holes 7 and even fall off from the positioning holes 7, causing the lamp 2 to fall. There is a doubt about the safety of use. Accordingly, the inventor of the present invention has devoted himself based on his many years of practical experiences to solve these problems.

SUMMARY OF THE INVENTION

The primary object of the present invention is to provide a lamp installation structure of a ceiling fan, which has the advantages of quick installation and increased stability of the ceiling fan.

In order to achieve the above object, the present invention provides a lamp installation structure of a ceiling fan, comprising two bases coupled to the ceiling fan and a plurality of elastic members. The ceiling fan has a fixing seat, a blade unit, a motor, and a lamp. The lamp has a heat dissipation plate. The bases are respectively secured to the fixing seat and the heat dissipation plate of the lamp. The bases are respectively defined as a first base and a second base. The first base has a first peripheral wall. The first peripheral wall is radially provided with a plurality of positioning members arranged at intervals. The second base has a second peripheral wall to be connected to the first peripheral wall. A connecting side of the second peripheral wall has an opening. The second peripheral wall is formed with recesses corresponding to the respective positioning members. One side of each recess communicates with the opening for receiving and positioning a corresponding one of the positioning members. The second peripheral wall has guide rails each extending in a guide direction on another side of the corresponding recess. The guide direction is perpendicular to an axial direction of the second base. The guide rails are configured to guide the respective positioning members. The guide rails each have a distal end. The guide rails each have two spaces on both sides adjacent to and away from a central axis of the second base. The two spaces are respectively defined as a first space and a second space. The first space of each guide rail is configured for displacement of the corresponding positioning member. The second peripheral wall is formed with grooves each disposed on one side of the corresponding guide rail adjacent to the opening and adjacent to the corresponding recess. The grooves correspond to the respective positioning members. The grooves are recessed toward the opening from the respective guide rails. The grooves are configured to position the respective positioning members. The elastic members correspond to the positioning members and the guide rails and are fixed to the respective guide rails. The elastic members are respectively arranged between the grooves and the distal ends of the guide rails. The elastic members each have an elastic portion. The elastic portion has a pressing end adjacent to the corresponding groove and an abutting end away from the corresponding groove. When the elastic members are in a normal state, the pressing end and the abutting end of the elastic portion of each elastic member are located in the first space of the corresponding guide rail. When the corresponding positioning member presses against the pressing end of the elastic portion of each elastic member, the elastic portion of each elastic member is in a stressed state, and the elastic portion of each elastic member is radially elastically displaced and compressed to the second space of the corresponding guide rail, so that the corresponding positioning member is moved to the distal end of the corresponding guide rail. When the elastic portion of each elastic member is in the normal state and the corresponding positioning member is located at the distal end of the corresponding guide rail, the abutting end of the elastic portion of each elastic member abuts against the corresponding positioning member.

In the lamp installation structure of the ceiling fan provided by the present invention, when the corresponding positioning member presses against the pressing end of the elastic portion of each elastic member, the elastic portion of each elastic member is radially elastically displaced and compressed, so that the corresponding positioning member is moved to the distal end of the corresponding guide rail. The first base and the second base are combined and fixed. The abutting ends of the elastic portions of the elastic elements are pressed against the positioning members to prevent the positioning members from leaving the distal ends of the guide rails. In addition, through the arrangement of the grooves, the positioning members can be prevented from disengaging from the guide rails, thereby enabling the lamp installation structure of the ceiling fan to have the advantages of quick installation and increasing the stability of the ceiling fan.

DETAILED DESCRIPTION OF THE PREFERRED EMBODIMENTS

Embodiments of the present invention will now be described, by way of example only, with reference to the accompanying drawings.

Figure 1:
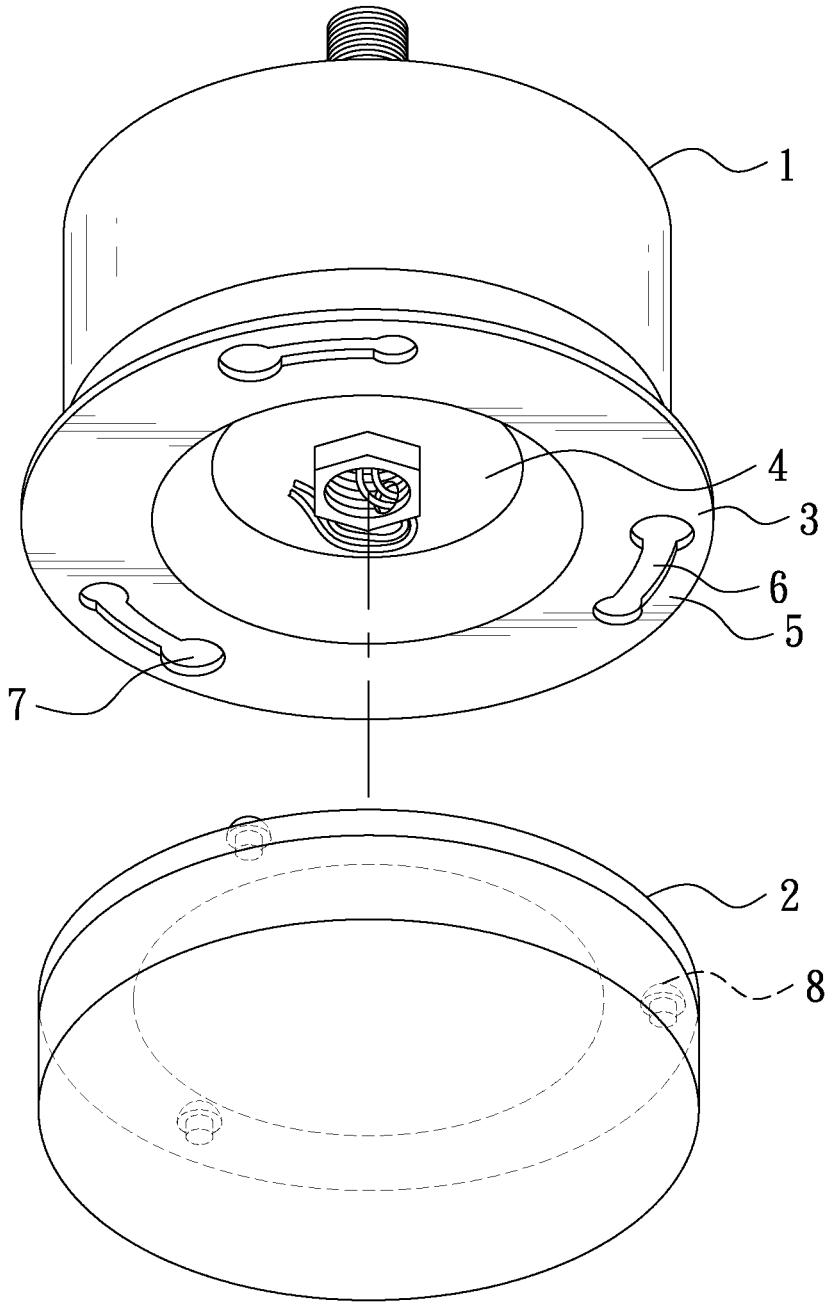
FIG. 1 PRIOR ART
FIG. 1 is an exploded view of a lamp structure of a conventional ceiling fan.
Figure 2:
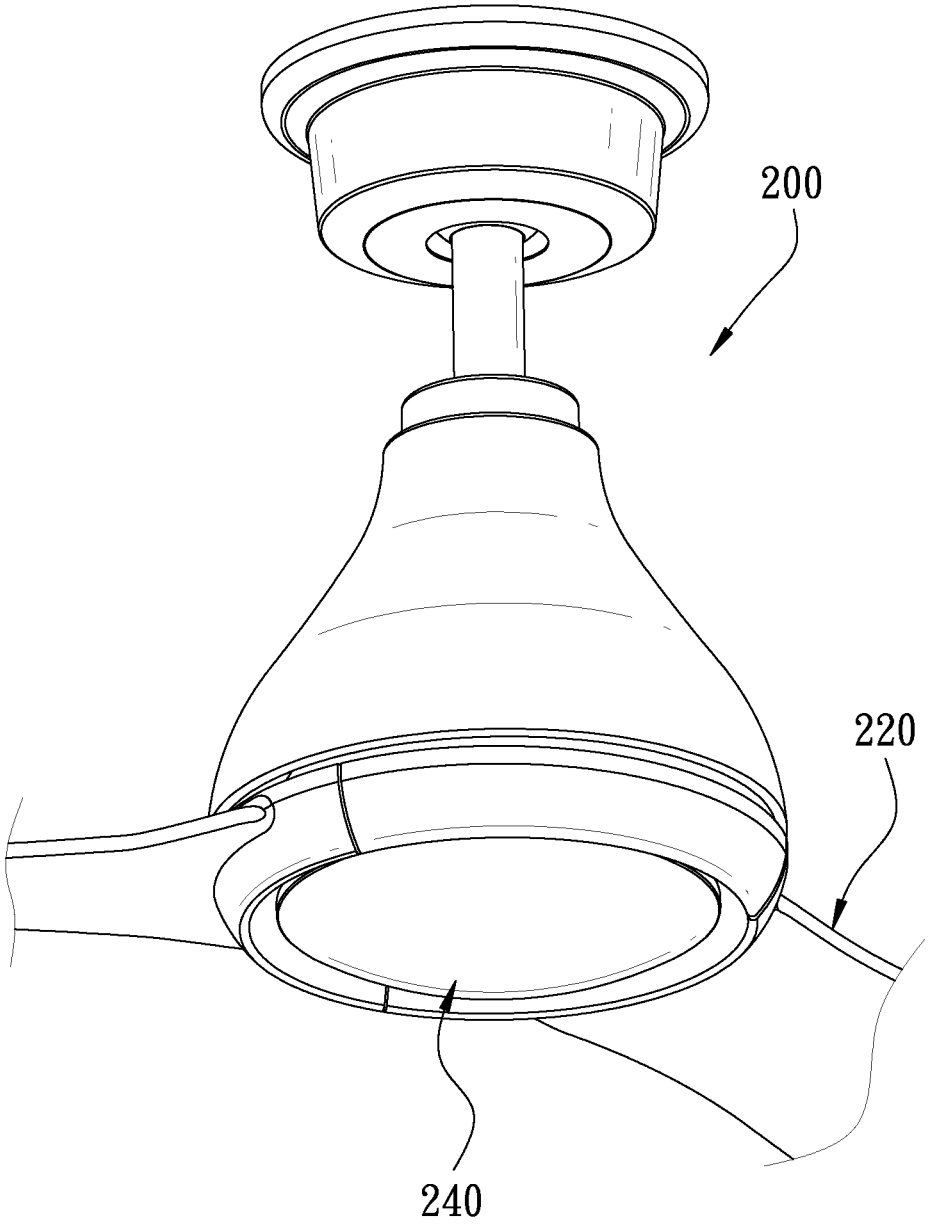
FIG. 2 is a perspective view in accordance with a preferred embodiment of the present invention.
Figure 3:
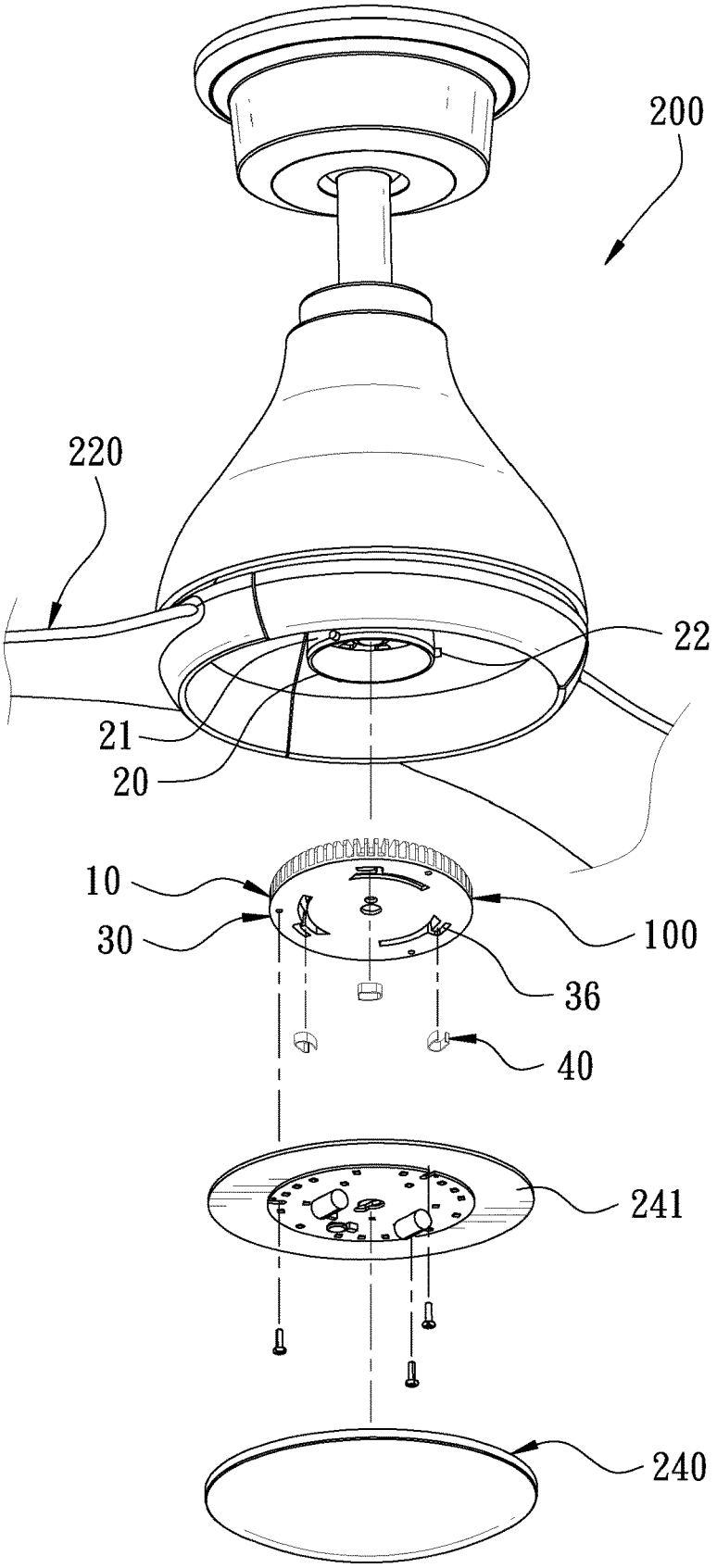
FIG. 3 is an exploded view in accordance with the preferred embodiment of the present invention.
Figure 4:
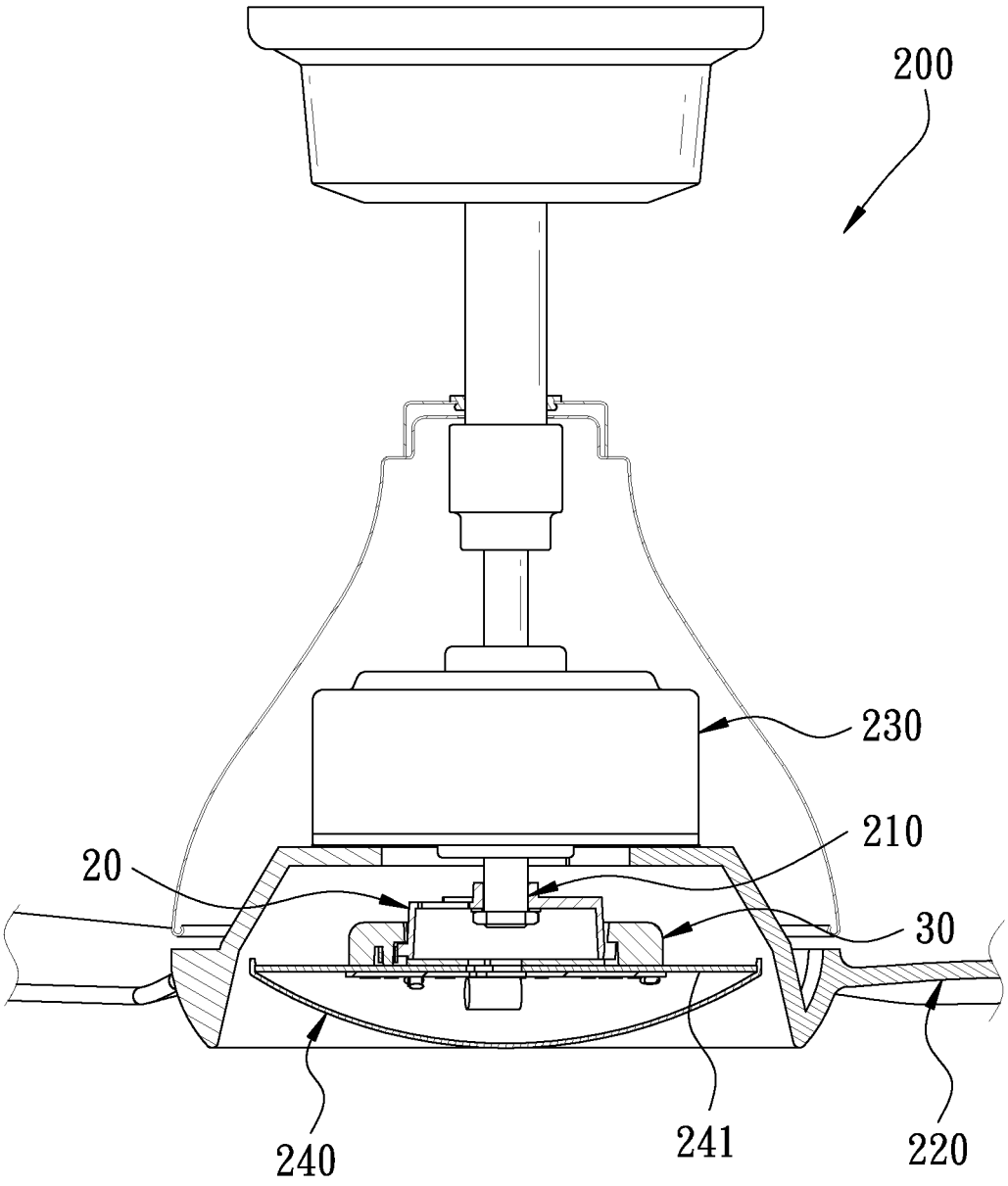
FIG. 4 is a cross-sectional view in accordance with the preferred embodiment of the present invention.

FIG. 2 is a perspective view in accordance with a preferred embodiment of the present invention. FIG. 3 is an exploded view in accordance with the preferred embodiment of the present invention. FIG. 4 is a cross-sectional view in accordance with the preferred embodiment of the present invention. The present invention discloses a lamp installation structure 100 of a ceiling fan 200, comprising two bases 10 coupled to the ceiling fan 200. The ceiling fan 200 has a fixing seat 210, a blade unit 220, a motor 230, and a lamp 240. The bases 10 and the lamp 240 are arranged under the motor 230 and the blade unit 220. The lamp 240 has a heat dissipation plate 241. The bases 10 are secured to the fixing seat 210 and the heat dissipation plate 241 of the lamp 240, respectively. The bases 10 are defined as a first base 20 and a second base 30, respectively.

The first base 20 is fixedly connected to the fixing seat 210. The first base 20 has a first peripheral wall 21. The first peripheral wall 21 is the outer wall of the first base 20. In the embodiment of the present invention, the first peripheral wall 21 is an annular wall. The first peripheral wall 21 is radially provided with a plurality of positioning members 22 which are arranged at intervals.

Figure 5:
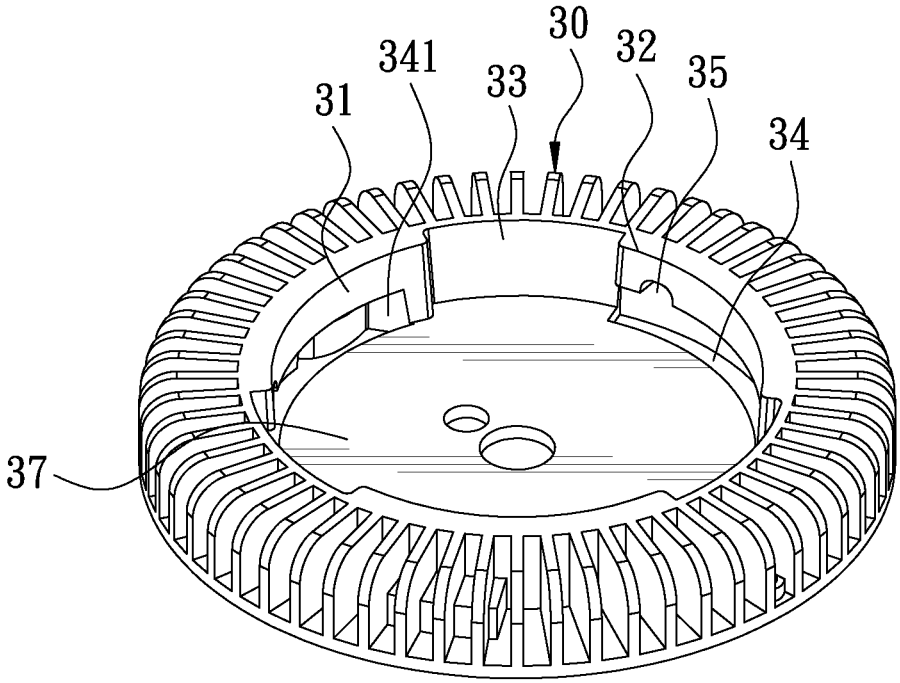
FIG. 5 is a partial enlarged view in accordance with the preferred embodiment of the present invention.

FIG. 5 is a partial enlarged view in accordance with the preferred embodiment of the present invention. The second base 30 has a second peripheral wall 31 to be connected to the first peripheral wall 21. The second peripheral wall 31 is the inner wall of the second base 30. In the embodiment of the present invention, the second peripheral wall 31 is an annular wall. A connecting side of the second peripheral wall 31 has an opening 32. The second peripheral wall 31 is formed with recesses 33 corresponding to the respective positioning members 22. The recesses 33 are radially recessed from the second peripheral wall 31. One side of each recess 33 communicates with the opening 32 for receiving and positioning a corresponding one of the positioning members 22. The second peripheral wall 31 has guide rails 34 each extending in a guide direction on the other side of the corresponding recess 33. The guide direction is perpendicular to the axial direction of the second base 30, so that the guide rails 34 are configured to guide the positioning members 22, respectively. The guide rails 34 are radially recessed from the second peripheral wall 31. The guide rails 34 each have a distal end 341. The guide rails 34 each have two spaces on both sides adjacent to and away from the central axis of the second base 30. The two spaces are defined as a first space 34*a* and a second space 34*b*, respectively. The first space 34*a* of each guide rail 34 is configured for displacement of the corresponding positioning member 22. The second peripheral wall 31 is formed with grooves 35 each disposed on one side of the corresponding guide rail 34 adjacent to the opening 32 and adjacent to the corresponding recess 33. The grooves 35 correspond to the positioning members 22, respectively. The grooves 35 are recessed toward the opening 32 from the respective guide rails 34. The grooves 35 are configured to position the positioning members 22, respectively. Furthermore, the guide rails 34 are each provided with an engaging slot 36. The second base 30 is provided with a bottom plate 37 on its one side away from the opening 32. The bottom plate 37 of the second base 30 is fixedly connected to the heat dissipation plate 241 of the lamp 240. The radius of the bottom plate 37 is greater than the radius of the second peripheral wall 31. The bottom plate 37 is formed with a plurality of perforations 38 corresponding in position to the respective engaging slots 36 and the respective guide rails 34 of the second base 30. The second base 30 is provided with a plurality of spaced heat dissipation fins 39 on the outer side of the second peripheral wall 31 and the bottom plate 37.

Figure 6:
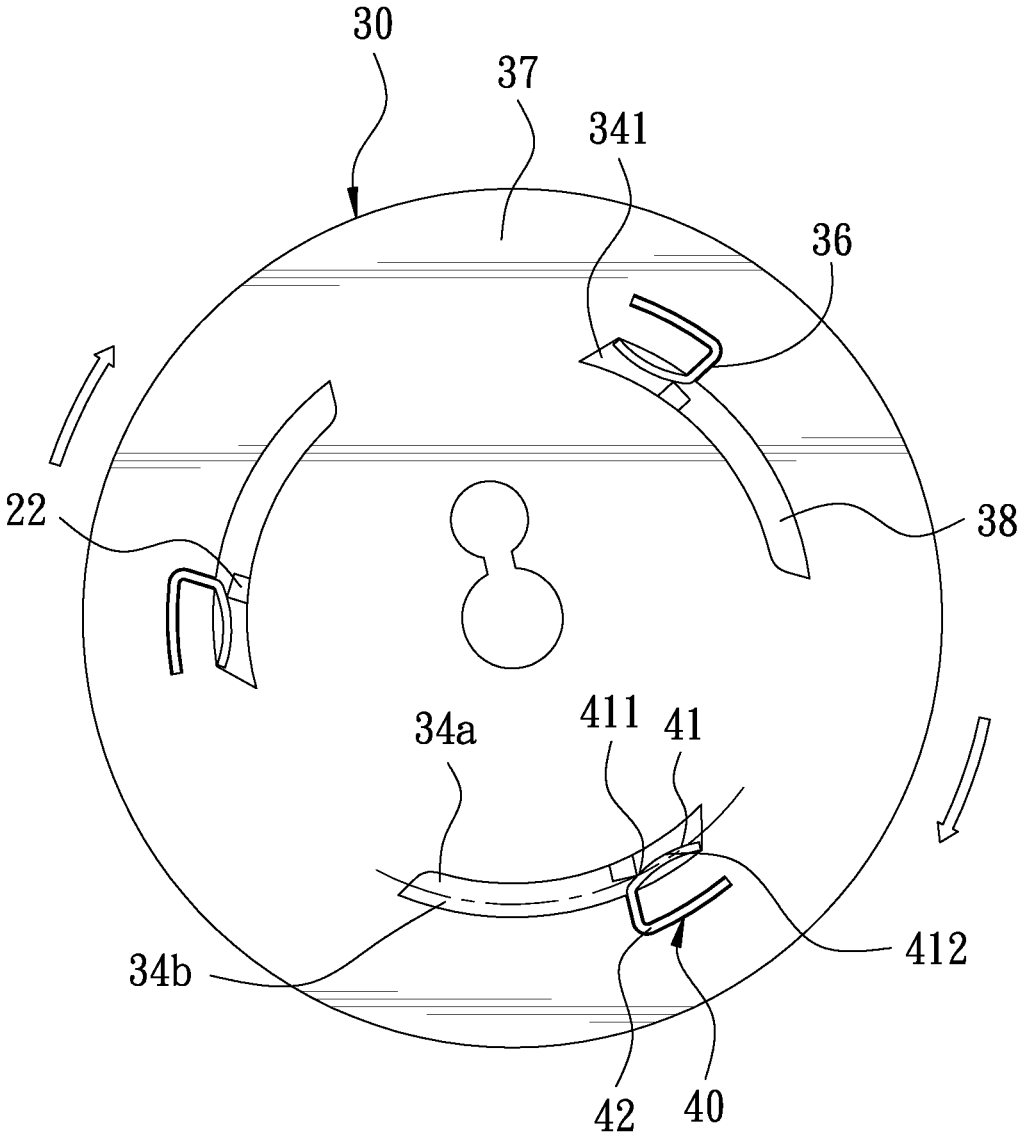
FIG. 6 is a first schematic view showing the operation of the preferred embodiment of the present invention.
Figure 7:
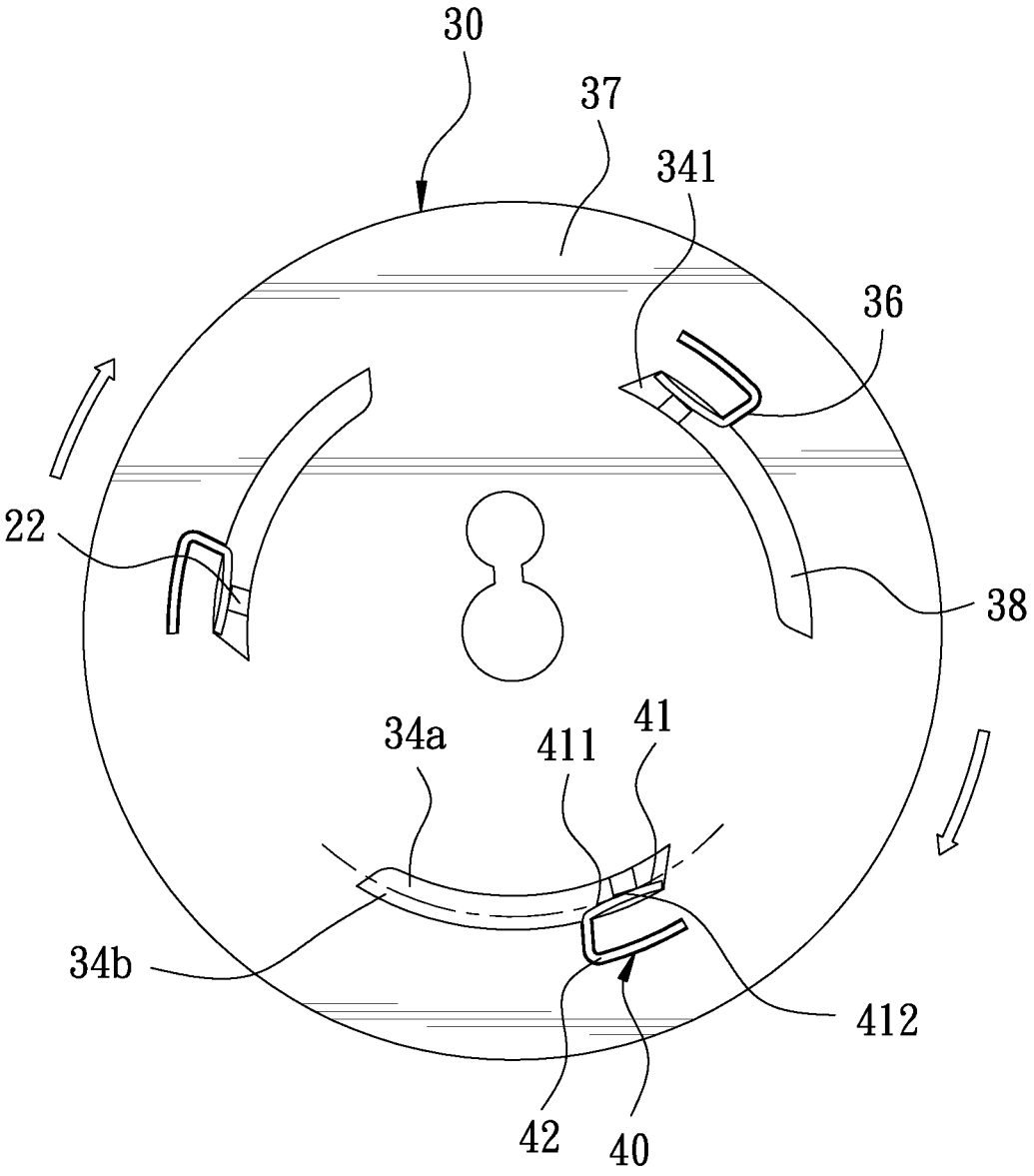
FIG. 7 is a second schematic view showing the operation of the preferred embodiment of the present invention.
Figure 8:
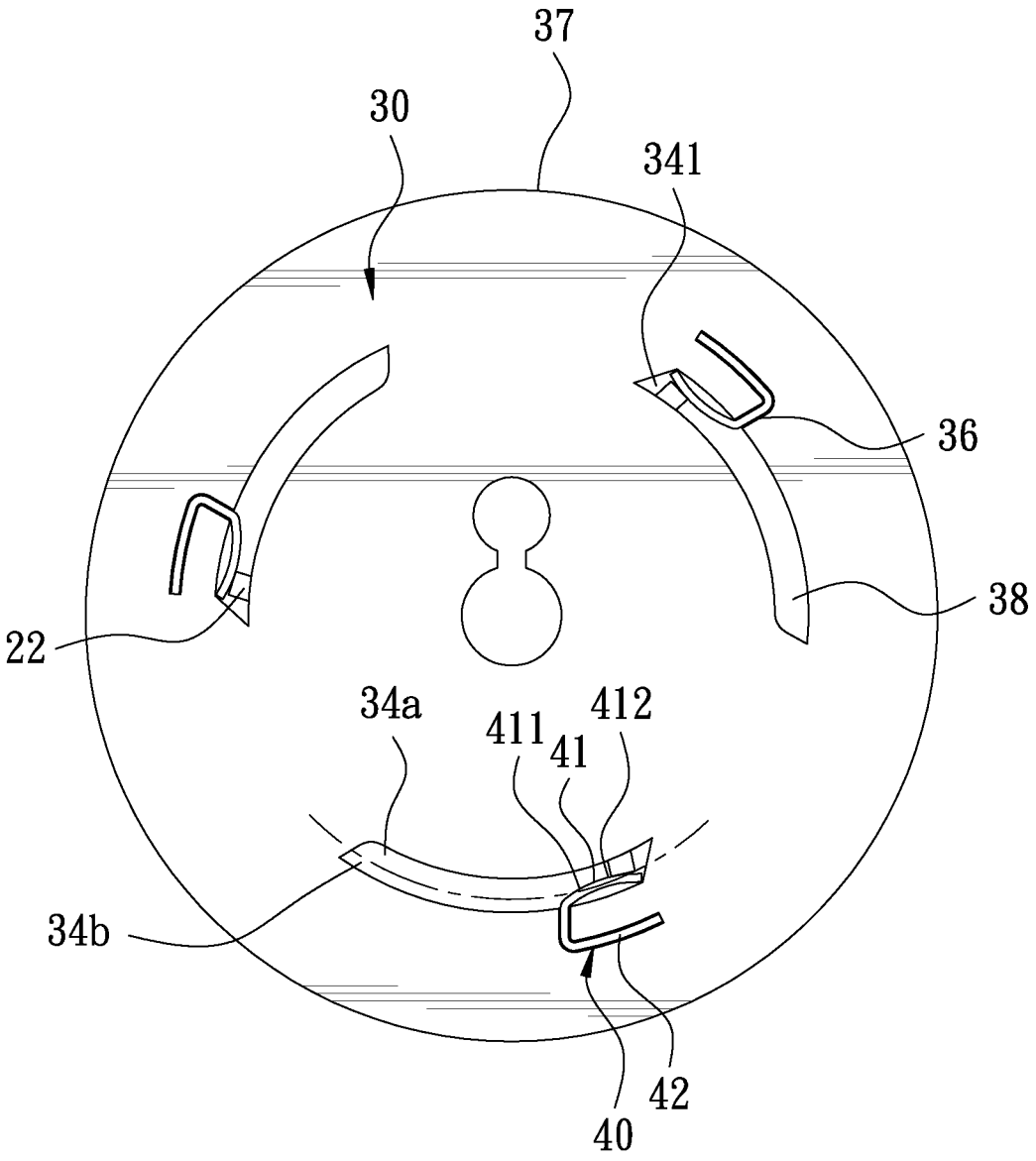
FIG. 8 is a third schematic view showing the operation of the preferred embodiment of the present invention.

FIGS. 6-8 are schematic views showing the operation of the preferred embodiment of the present invention. The lamp installation structure 100 further comprises a plurality of elastic members 40. The elastic members 40 correspond to the positioning members 22 and the guide rails 34, and are fixed to the respective guide rails 34. The elastic members 40 are arranged between the grooves 35 and the distal ends 341 of the guide rails 34, respectively. The elastic members 40 each have an elastic portion 41. The elastic portion 41 has a pressing end 411 adjacent to the corresponding groove 35 and an abutting end 412 away from the corresponding groove 35. The elastic portion 41 of each elastic member 40 is an arc-shaped leaf spring. The pressing end 411 and the abutting end 412 of each elastic member 40 are located on both sides of the elastic portion 41 of each elastic member 40. When the elastic members 40 are in a normal state, the pressing end 411 and the abutting end 412 of the elastic portion 41 of each elastic member 40 are located in the first space 34*a* of the corresponding guide rail 34. In the embodiment of the present invention, the pressing end 411 of the elastic portion 41 is a closed end, and the abutting end 412 of the elastic portion 41 is a free end. When the corresponding positioning member 22 presses against the pressing end 411 of the elastic portion 41 of each elastic member 40, the elastic portion 41 of each elastic member 40 is in a stressed state, and the elastic portion 41 of each elastic member 40 is radially elastically displaced and compressed to the second space 34*b* of the corresponding guide rail 34, so that the corresponding positioning member 22 is moved to the distal end 341 of the corresponding guide rail 34. When the elastic portion 41 of each elastic member 40 is in the normal state and the corresponding positioning member 22 is located at the distal end 341 of the corresponding guide rail 34, the abutting end 412 of the elastic portion 41 of each elastic member 40 abuts against the corresponding positioning member 22. In addition, the elastic members 40 each have a body portion 42 connected to the elastic portion 41. The body portion 42 of each elastic member 40 is fixed in the corresponding engaging slot 36.

Figure 9:
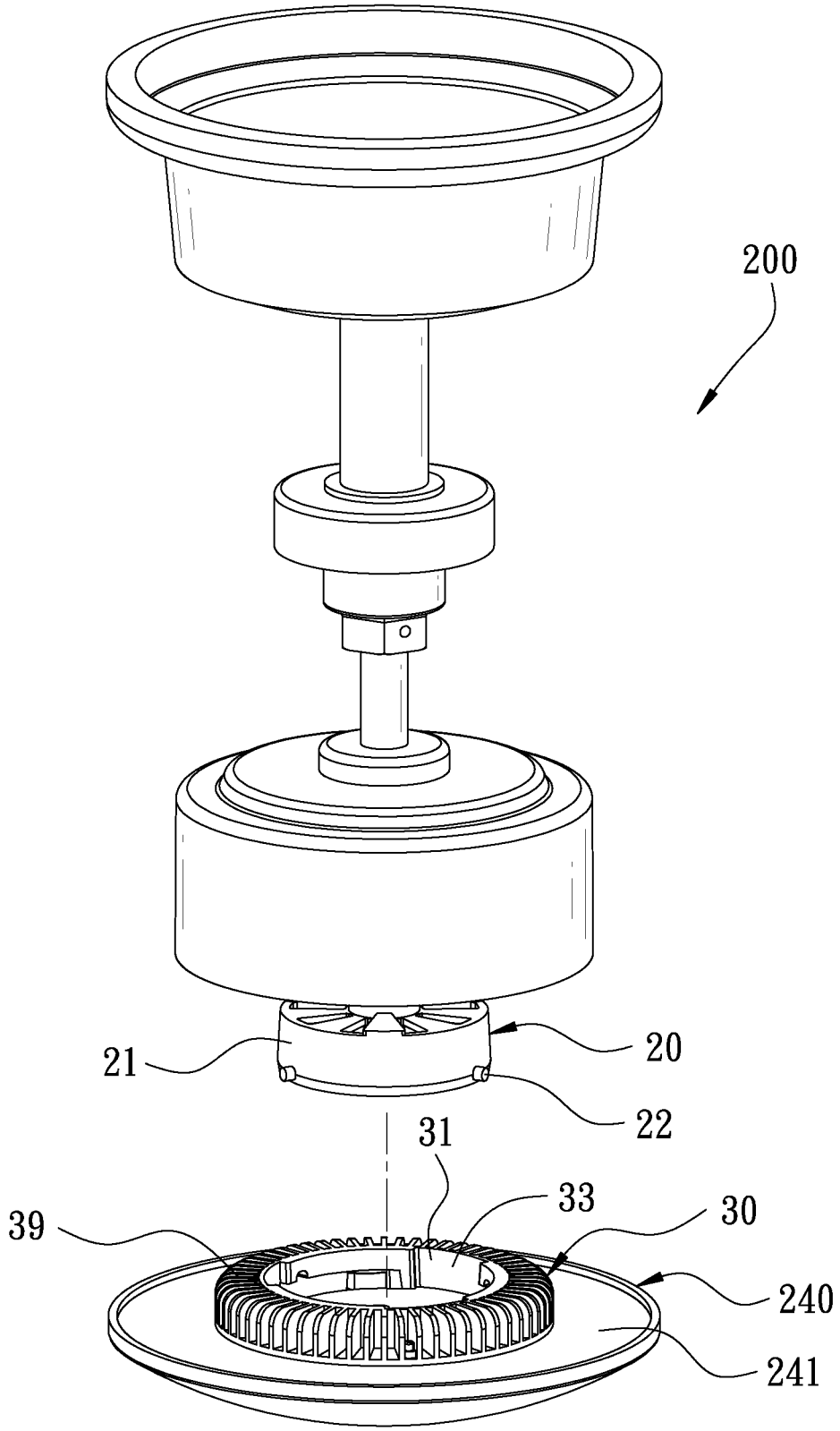
FIG. 9 is a schematic view of the assembly of the preferred embodiment of the present invention.

FIGS. 6-8 are schematic views showing the operation of the preferred embodiment of the present invention. FIG. 9 is a schematic view of the assembly of the preferred embodiment of the present invention. When the lamp installation structure 100 of the ceiling fan is to be assembled, the positioning members 22 of the first base 20 are aligned with the respective recesses 33 of the second base 30, and the first base 20 is moved toward the opening 32 of the second base 30, and the first peripheral wall 21 of the first base 20 is connected with the second peripheral wall 31 of the second base 30. At this time, each positioning member 22 of the first peripheral wall 21 is moved along the guide direction toward the elastic portion 41 of the corresponding elastic member 40. The positioning members 22 press against the pressing ends 411 of the elastic portions 41 of the elastic members 40 in the first spaces 34*a* of the guide rails 34, respectively. The elastic portions 41 are radially, elastically displaced and compressed to the second spaces 34*b* of the guide rails 34, so that the positioning members 22 pass through the elastic portions 41 of the elastic members 40 and are displaced to the distal ends 341 of the guide rails 34, respectively. The abutting ends 412 of the elastic portions 41 of the elastic members 40 abut against the respective positioning members 22, so that the first peripheral wall 21 of the first base 20 and the second peripheral wall 31 of the second base 30 are rotatably connected and secured. Furthermore, the fixing seat 210 and the lamp 240 are combined and secured to complete the assembly of the ceiling fan 200 quickly.

When the lamp installation structure 100 of the ceiling fan is to be disassembled or replaced, the second base 30 and the lamp 240 are rotated in the opposite direction, so that the positioning members 22 are moved toward the opening 32 in the direction opposite to the guide direction and are moved out of the guide rails 34 and the recesses 33, respectively. That is, the first base 20 is separated from the second base 30, and the lamp 240 is also separated from the fixing seat 210, so that the lamp 240 can be easily replaced.

It is worth mentioning that if the ceiling fan 200 runs and vibrates for a long time, it may cause the positioning members 22 to be loose or displaced, and the positioning members 22 are moved in the direction of the recesses 33 from the guide rails 34, respectively. At this time, the abutting ends 412 of the elastic portions 41 of the elastic members 40 abut against the positioning members 22 to prevent the positioning members 22 from leaving the distal ends 341 of the guide rails 34, respectively. In addition, the engaging slots 36 of the second base 30 have the function of retaining the positioning members 22, so as to prevent the positioning members 22 from moving to the recesses 33 to fall off. Thus, the first base 20 and the second base 30 won't be separated to cause the lamp 240 to fall, thereby improving safety.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A lamp installation structure of a ceiling fan, comprising two bases coupled to the ceiling fan and a plurality of elastic members, the ceiling fan having a fixing seat, a blade unit, a motor and a lamp, the lamp having a heat dissipation plate, the bases being respectively secured to the fixing seat and the heat dissipation plate of the lamp, the bases being respectively defined as a first base and a second base, characterized in that:

the first base has a first peripheral wall, the first peripheral wall is radially provided with a plurality of positioning members arranged at intervals;

the second base has a second peripheral wall to be connected to the first peripheral wall, a connecting side of the second peripheral wall has an opening, the second peripheral wall is formed with recesses corresponding to the respective positioning members, one side of each recess communicates with the opening for receiving and positioning a corresponding one of the positioning members, the second peripheral wall has guide rails each extending in a guide direction on another side of the corresponding recess, the guide direction is perpendicular to an axial direction of the second base, the guide rails are configured to guide the respective positioning members, the guide rails each have a distal end, the guide rails each have two spaces on both sides adjacent to and away from a central axis of the second base, the two spaces are respectively defined as a first space and a second space, the first space of each guide rail is configured for displacement of the corresponding positioning member, the second peripheral wall is formed with grooves each disposed on one side of the corresponding guide rail adjacent to the opening and adjacent to the corresponding recess, the grooves correspond to the respective positioning members, the grooves are recessed toward the opening from the respective guide rails, the grooves are configured to position the respective positioning members;

the elastic members correspond to the positioning members and the guide rails and are fixed to the respective guide rails, the elastic members are respectively arranged between the grooves and the distal ends of the guide rails, the elastic members each have an elastic portion, the elastic portion has a pressing end adjacent to the corresponding groove and an abutting end away from the corresponding groove, when the elastic members are in a normal state, the pressing end and the abutting end of the elastic portion of each elastic member are located in the first space of the corresponding guide rail, when the corresponding positioning member presses against the pressing end of the elastic portion of each elastic member, the elastic portion of each elastic member is in a stressed state, and the elastic portion of each elastic member is radially elastically displaced and compressed to the second space of the corresponding guide rail, so that the corresponding positioning member is moved to the distal end of the corresponding guide rail, when the elastic portion of each elastic member is in the normal state and the corresponding positioning member is located at the distal end of the corresponding guide rail, the abutting end of the elastic portion of each elastic member abuts against the corresponding positioning member.

2. The lamp installation structure of the ceiling fan as claimed in claim 1, wherein the elastic members each have a body portion connected to the elastic portion, the guide rails each have an engaging slot, the body portion of each elastic member is fixed in the engaging slot, the elastic portion of each elastic member is an arc-shaped leaf spring, the pressing end of the elastic portion is a closed end, the abutting end of the elastic portion is a free end, the pressing end and the abutting end of each elastic member are located on both sides of the elastic portion of each elastic member.

3. The lamp installation structure of the ceiling fan as claimed in claim 1, wherein the first peripheral wall is an annular wall, and the second peripheral wall is an annular wall.

4. The lamp installation structure of the ceiling fan as claimed in claim 1, wherein the first peripheral wall is an outer wall of the first base, and the second peripheral wall is an inner wall of the second base.

5. The lamp installation structure of the ceiling fan as claimed in claim 4, wherein the second base is provided with a bottom plate on its one side away from the opening, the bottom plate has a radius greater than that of the second peripheral wall, the bottom plate is formed with a plurality of perforations corresponding in position to the respective engaging slots and the respective guide rails of the second base, the second base is provided with a plurality of spaced heat dissipation fins on an outer side of the second peripheral wall and the bottom plate, the bottom plate of the second base is fixedly connected to the heat dissipation plate, and the first base is fixedly connected to the fixing seat.

6. The lamp installation structure of the ceiling fan as claimed in claim 1, wherein the bases and the lamp are arranged under the motor and the blade unit.

7. The lamp installation structure of the ceiling fan as claimed in claim 1, wherein the recesses are radially recessed from the second peripheral wall, and the guide rails are radially recessed from the second peripheral wall.

* * * * *